US006223448B1

(12) United States Patent
Motzke et al.

(10) Patent No.: US 6,223,448 B1
(45) Date of Patent: May 1, 2001

(54) DEVICE FOR CONDITIONING A PAPER WEB

(75) Inventors: Michael Motzke; Bruno Brischler, both of Augsburg (DE)

(73) Assignee: Baldwin Grafotec GmbH, Augsburg (DE)

( * ) Notice: Subject to any disclaimer, the term of this patent is extended or adjusted under 35 U.S.C. 154(b) by 0 days.

(21) Appl. No.: 09/467,919

(22) Filed: Dec. 21, 1999

(30) Foreign Application Priority Data

Jan. 19, 1999 (DE) ..... 199 01 801

(51) Int. Cl.[7] ..... F26B 13/00

(52) U.S. Cl. ..... 34/61; 34/62; 34/636; 34/638; 34/643

(58) Field of Search ..... 34/561, 60, 61, 34/62, 114, 115, 618, 629, 636, 638, 643; 101/416.1, 424.1, 487, 488

(56) References Cited

U.S. PATENT DOCUMENTS 3,599,554 * 8/1971 Aelterman ..... 34/557 X
4,462,169 * 7/1984 Daane ..... 34/62
4,523,391 * 6/1985 Smith et al. ..... 34/638
5,571,564 * 11/1996 Helms et al. ..... 101/487 X
5,642,671 * 7/1997 Winheim ..... 101/424.1 X
5,813,332 * 9/1998 Reichel-Langer et al. ..... 101/147
5,845,415 * 12/1998 Sundqvist ..... 34/452
5,906,862 * 5/1999 Yapel et al. ..... 34/421 X
5,970,626 * 10/1999 Schmidt et al. ..... 34/636 X

* cited by examiner

*Primary Examiner*—Stephen Gravini
(74) *Attorney, Agent, or Firm*—Jones, Tullar & Cooper, P.C.

(57) ABSTRACT

In a device for conditioning a preferably freshly printed paper web (2) with a dryer (1) and a remoistening device, wherein the dryer (1) exhibits a heating zone (3), a temperature maintenance zone (4) and a cooling zone (5) and the remoistening device exhibits spray jets (10), arrayed above and below the transport surface of the said paper web (2), through which moisturizing agents can be admitted, and spray chambers (9) containing the same, a particularly compact form of construction is achieved, in that the cooling zone (5) of the dryer (1) contains a moisturizing device (8) for the purpose of remoistening and cooling the said paper web (2).

11 Claims, 1 Drawing Sheet

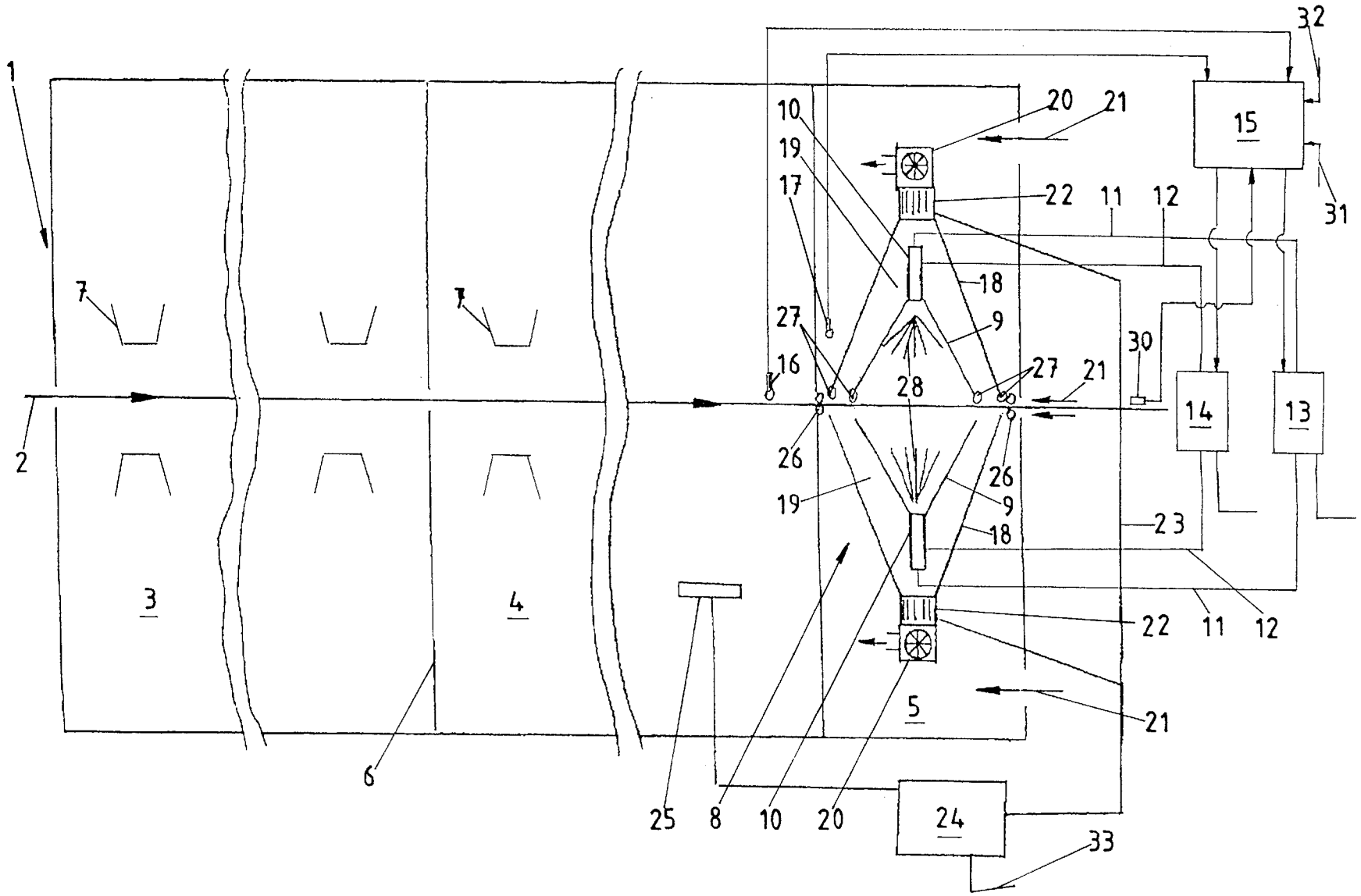
32
31
15
13
14
12
11
23
22
21
30
33
20
18
9
27
26
28
5
24
10
19
17
16
8
25
4
6
7
3
1
2

DEVICE FOR CONDITIONING A PAPER WEB

FIELD OF THE INVENTION

The invention concerns a device for conditioning a preferably freshly printed paper web with a dryer and remoistening apparatus, wherein the dryer has a heating zone, a temperature maintenance zone and a cooling zone and the remoistening apparatus has spray jets, through which moisturising agents can be admitted, arrayed above and below the transport surface of the paper web and spray chambers containing the same.

BACKGROUND OF THE INVENTION

A device of this kind is known from DE 44 05 332 A1. In this known array, between the exit of the dryer and a chilling roller stand situated immediately downstream of it, provision is made for a tunnel housing through which the paper web passes and which presents two sections arrayed one after the other, of which the section more distant from the dryer takes the form of a remoistening apparatus with chambers containing spray jets, set above and below the transport surface of the paper web, through which moisturising means can be admitted, while the section closer to the dryer is equipped with air squeegees arrayed above and below the transport surface of the paper web, through which compressed air can be admitted, whose function is to scrape off solvents that have been transported together with the paper web. The tunnel housing built onto the dryer constitutes a comparably large volume between the dryer and the chilling roller stand. The cooling zone of the known dryer generally includes air jets through which cool air can be admitted. As the air's heating capacity is relatively small, a relatively large volume is also required in this case, quite regardless of the construction outlay.

SUMMARY OF THE INVENTION

Starting from this, it is therefore the task of the present invention to improve a device of the kind mentioned above with simple, cheap means, so that it is possible to obtain a compact overall method of construction.

According to the invention, this task is achieved in that the cooling zone of the dryer contains a moisturising apparatus for remoistening and cooling the paper web.

As the remoistening device according to the invention is integrated into the dryer, the distance between the said dryer and a chilling roller stand arrayed immediately downstream of it can be relatively small, so that the result is a relatively short assembly array. The dryer itself can also be relatively compact as a consequence of the cooling liquid being applied to the paper web. This is because the liquid applied for the purpose of moistening the paper web has a relatively high heat capacity in comparison to the heat capacity of air, so that even a relatively small amount of moisturising agent can be relied upon to be sufficient for bringing about a cooling of the web. This means that relatively few spray jets are necessary, which saves volume and has an advantageous fallout effect in terms of avoiding disturbance to the paper web as its runs. One further advantage of the measures according to the invention can be seen in the fact that, as a result of their high penetration force and also a result of the increased volume produced by the vaporisation, the moisturiser jets can be relied on to break down the laminate air layer laden with solvent that flanks the paper web. This ensures that this solvent-laden air is already brought to separate from the paper web in the dryer, which facilitates disposal, as the dryer is certainly fitted with suitable equipment, and avoids any undesirable external dissemination of solvent. At the same time, this also ensures that no additional means are necessary for breaking the laminate air layer down, as in the case of the tunnel with and without blow jets to be found in the state of the art, which also saves in terms of volume and construction outlay.

Advantageous embodiments and functional further developments on the above-listed measures are described in the sub-claims. Thus the amount of moisturising agent channelled to the spray jets is functionally greater than the amount of remoisturising agent. This guarantees that, in addition to the remoistening, there is also a reliable cooling of the paper web.

One further advantageous measure may consist of the fact that the spray jets can be provided with moisturising agents and compressed air to be blown out. This achieves a good distribution of the said moisturising agent and in particular also a high penetration force of the same in an advantageous manner.

One further, particularly preferable, measure may consist of arraying the spray chambers each in a dedicated suction chamber, which can be sucked out by means of at least one dedicated extraction fan blowing out into the dryer. This results in exhaust shafts flanking the spray chambers on the entry and exit sides, which guarantee a reliable extraction of the large air volume to be expected. As the extraction shafts are sucked out, it is certain that no air can make its way outside. The air squeegees can thus either be eliminated completely or have relatively modest dimensions, which has an advantageous effect on avoiding outlay and avoiding any disturbance to the web. At the same time, this also guarantees that no moisture makes it way outside. There is therefore no need to fear that condensation will collect outside the moisturising apparatus. As the blower(s) blow(s) into the dryer, the resulting method of construction is also relatively simple. Moreover, this measure also proves to be energy-economic, as the air blown out is already tempered.

At least one cooler can be arrayed functionally with each extraction fan. This ensures that the oil and water transported with the air are separated, which facilitates disposal.

Additional advantageous embodiments and functional further developments on the above-listed measures are described in the other sub-claims and can be deduced in greater detail from the following description of examples, with the aid of the drawing.

BRIEF DESCRIPTION OF THE DRAWING

The drawing described hereunder illustrates a schematic longitudinal cross-section through a dryer equipped with a moisturising device.

DESCRIPTION OF THE PREFERRED EMBODIMENTS

The field in which the invention is applied is generally that of web-fed rotary printing presses with a dryer arrayed in a position immediately downstream. The basic construction and the method of functioning of such arrays are already known. The following description is therefore restricted substantially to the area of the dryer affected by invention.

The dryer 1 illustrated in the drawing, which is arrayed between a web-fed rotary printing process not illustrated here in any detail and a chilling roller stand, also not illustrated here in any detail, has three zones arrayed one after the other in the direction in which the paper web 2 moves, namely a heating zone 3, a temperature maintenance zone 4 and a cooling zone 5. A section inside the housing of the dryer 1 is devoted to each zone. Partition bulkheads 6 are provided between the contiguous sections.

In the heating zone 3 and the temperature maintenance zone 4, the paper web is sprayed with hot air, as indicated through jets 7. The section devoted to the cooling zone contains a moisturising device indicated in its entirety with the number 8, whose purpose is to cool and remoisten the paper web 2, which loses moisture in the preceding zones because of the heat treatment situated there.

A moisturising agent, preferably in the form of water, is admitted to the paper web 2 with the aid of the moisturising device 8. The amount of moisturising agent applied to the paper web 2 during this process is great enough to cool the paper web 2 down to the desired temperature and at the same time to increase the moisture content of the paper web 2 to the desired level. The cooling is brought about by vaporising liquid, while the vaporisation heat is withdrawn from the paper web 2. However, the vaporising liquid does not produce any remoisturising. The total quantity of the liquid channelled to the paper web 2 thus consists of a remoisturising share and an additional amount for cooling purposes.

The total amount of liquid is adjusted correspondingly as a function of the need of the paper web 2 for moisture and of the desired difference in cooling temperature. In simple cases, provision can be made for a control system that depends on the temperature of the paper web 2 before the moisturising device 8, i.e. practically at the exit of the temperature maintenance zone 4, as well as on the velocity of the web and the type of paper. Another form of control is also feasible, however, in which, in addition or as an alternative, the moisture and/or the temperature of the paper web 2 after the moisturising device 8 and/or the temperature in the cooling zone 5 are fed in as nominal values.

The moisturising device 8 is equipped with roof- or v-shaped spray chambers 9 above and below the transport surface of the paper web 2, each of which contains a row of spray jets 10 covering the entire width of the said paper web 2. Provision could of course be made for several rows of jets. The row of spray jets stretches practically across the entire width of the dryer and can be adjusted to the width of the paper web by switching off the outer jets.

In the example illustrated, a moisturising agent, preferably in the form of water, and compressed air are admitted through the spray jets 10, for the purpose of blowing the moisturising agent out and dedusting it, as indicated by the supply conduits 11, 12. These are fitted with switching mechanisms in the shape of valves etc., which in this case can be regulated by means of an adjustment device 15, which exhibits the nominal value inputs for the temperature of the paper web 2 before moisturising, the temperature of the cooling zone 5 and the moisture and temperature of the paper web 2 after moisturising. These nominal value inputs are connected via signalling lines to dedicated sensors, here the temperature probes 16, 17 and a combined temperature and moisture probe 30.

The temperature probe 16 dedicated to the web temperature before moisturising is arrayed in the exit area of the temperature maintenance zone 4, in the vicinity of the paper web 2. The temperature probe 17 dedicated to the temperature in the cooling zone 5 is arrayed in the cooling zone 5, outside the moisturising device 8. The combined temperature and moisture probe 30 is arrayed in the area of the exit of the dryer 1. In addition, the control device 15 is also equipped with a further entrance 31 for the web velocity, preferably coupled with the printing press, and with an input station 32 for inputting fixed parameters, such as the type of paper.

Each of the spray chambers 9 is overlapped above or below by a dedicated roof- or v-shaped suction chamber 18, in such a way that extraction shafts 19 result on the entry and the exit sides. These are sucked out individually or together. For this purpose, in the example illustrated, an extraction fan 20 is provided, arrayed in the area of the corner of each suction chamber 18 situated furthest away from the paper web, whose function is to suck out the dedicated suction chamber 18 in question and blow into the section of the dryer 1 dedicated to the cooling zone 5. In this way, tempered air is channelled to the dryer 1, so that the amount of fresh air sucked in from outside and indicated with arrow 21 can be reduced accordingly, which has a positive effect on overall energy consumption.

A cooler 22 is arrayed upstream of each extraction fan 20. This cooler functions practically as a condenser for separating out liquids in the form of moisture and oil from the extracted air. Relatively unloaded air is thence channelled through the extraction fan 20 to the dryer 1. The condensation separated out by means of the cooler 22 is siphoned off by means of a condensation drainage conduit 23. This leads via a water separator 24, where water is separated out, to an oil vaporiser 25 situated preferably in the dryer 1, but illustrated here in the temperature maintenance zone 4, where oil is evaporated, so that it can be disposed of by means of the dryer's own post-combustion plants. In order to avoid the need for disposal, the separated water can be channelled back to the jets 10. For this purpose, the water outlet 33 of the water separator 24 can be conducted back into the supply conduit 11. The inlet is situated suitably upstream from the switching mechanism 13.

Air squeegees 26 through which compressed air can be admitted can be provided at the entrance and the exit of the suction chambers 18, with the function of avoiding any air loaded with moisture escaping from the suction chambers 18. This guarantees that no condensation can collect outside the moisturising device 8 inside and outside the dryer, which might otherwise drip onto the paper web 2 and dirty it. Condensation collects on the internal sides of the spray chambers 9 and the suction chambers 18 and then drains off downwards. In the lower chambers, this condensation drains into the cooler 22 and is channelled away through the drainage conduits that are certainly already provided there. In order to avoid condensation dripping from the lower edges of the bulkheads, the upper spray chamber 9 and the suction chamber 18 are equipped with drop catchers 27, which can be affixed functionally to the condensation drainage conduit 23 in a way not illustrated here in any detail.

The consequence of the liquid cooling of the paper web 2 that can be achieved by integrating the moisturising device 8 in the cooling zone 5, as can be seen clearly from the drawing, is a construction of the cooling zone 5 that is very compact compared to the zones 3 and 4. The liquid streams 28 that can be generated by means of the spray jets 10 have a high penetrating force, whereby the laminate air layers flanking the paper web 2, which are loaded with solvents, can be relied on to be broken down. This is also supported by the increase in volume resulting from the vaporisation. The solvent is sucked out together with the air and can be relied on to be disposed of together with it.

What is claimed is:

1. A device for conditioning a preferably freshly printed paper web with a dryer and a remoistening device, wherein the dryer exhibits a heating zone, a temperature maintenance zone and a cooling zone and the remoistening device exhibits spray jets through which moisturising agents can be admitted, arrayed above and below the transport surface of the paper web, and spray chambers containing the same, whereby the cooling zone of the dryer contains a moisturising device for the purpose of remoistening and cooling the paper web.

2. A device according to claim 1, whereby the amount of moisturising agent channelled to the spray jets is greater than the remoistening amount.

3. A device according to claim 2, whereby the amount of moisturising agent channelled to the spray jets can be adjusted, by means of an adjustment device, as a function of velocity of the paper web, of the type of paper, of the temperature of the paper web upstream of the moisturising device and/or the temperature in the cooling zone of the dryer and/or the humidity and/or the temperature of the paper web downstream of the moisturising device.

4. A device according to claim 1, whereby a moisturising agent and compressed air can be admitted through the spray jets for the purpose of blowing out the moisturising agent.

5. A device according to claim 1, whereby each of the spray chambers is arrayed in a dedicated suction chamber, which can be sucked out by means of at least one dedicated extraction fan blowing out into the dryer.

6. A device according to claim 5, whereby at least one cooler is arrayed upstream of each extraction fan.

7. A device according to claim 6, whereby each cooler is connected via a condensation drainage conduit to an oil vaporiser arrayed in the dryer, preferably in the area of the temperature maintenance zone of the said dryer.

8. A device according to claim 6, whereby at least one water separator is arrayed downstream of each cooler.

9. A device according to claim 5, whereby air squeegees through which compressed air can be admitted are provided at the entrance and the exit of the suction chamber.

10. A device according to claim 5, whereby drop catchers are situated at the lower ends of the bulkheads of the upper spray chamber and suction chamber.

11. A device according to claim 5, whereby the spray chambers (9) and the suction chambers have a roof- or v-shaped form.

* * * * *